US005106656A

United States Patent [19]

Nakaoka et al.

[11] Patent Number: 5,106,656

[45] Date of Patent: Apr. 21, 1992

[54] METHOD OF HOT-MELT SIZING OF WARPS FOR WEAVING

[75] Inventors: Yoshihiko Nakaoka; Isao Murase, both of Aichi, Japan

[73] Assignee: Takemoto Yushi Kabushiki Kaisha, Aichi, Japan

[21] Appl. No.: 579,175

[22] Filed: Sep. 5, 1990

Related U.S. Application Data

[63] Continuation of Ser. No. 257,408, Oct. 13, 1988, abandoned.

[30] Foreign Application Priority Data

Oct. 17, 1987 [JP] Japan ..... 62-262463

[51] Int. Cl.[5] ..... B05D 3/12

[52] U.S. Cl. ..... 427/359; 427/394; 427/428

[58] Field of Search ..... 427/359, 394, 428; 28/178, 179, 180, 183; 252/8.6; 8/115.6; 118/124, 123, 244, 258, 60, 65

[56] References Cited

U.S. PATENT DOCUMENTS

| | | | |
|---|---|---|---|
| 890,782 | 6/1908 | Masurel-Leclercq | 28/180 X |
| 2,933,417 | 4/1960 | McIntyre, Jr. | 427/365 X |
| 2,971,931 | 2/1961 | Glade | 427/394 X |
| 3,466,717 | 9/1969 | Kuroda | 28/180 |
| 3,853,820 | 12/1974 | Vachon | 260/75 T |
| 3,882,090 | 5/1975 | Fagergurg et al. | 260/78 R |
| 3,899,810 | 8/1975 | Stanley et al. | 28/183 X |
| 3,990,132 | 11/1076 | Illman et al. | 427/428 X |
| 4,136,069 | 1/1979 | Vachon et al. | 252/8.6 X |
| 4,253,840 | 3/1981 | Illman et al. | 8/115.6 |
| 4,401,782 | 8/1983 | Conklin et al. | 8/115.6 X |
| 4,459,129 | 7/1984 | Gooding et al. | 8/115.6 |

OTHER PUBLICATIONS

Encyclopedia of Polymer Science and Technology; vol. 7, pp. 2-3, 14-27, 39-43, copyright 1967; vol. 14, pp. 772, copyright 1971; John Wiley & Sons, Inc.

Thiery, P.; Fireproofing; Elsevier Pub. Co. Limited; copyright 1970; pp. 81-95.

Schick, M. J.; Surface Characteristics of Fibers and Textiles; Marcel Dekker, Inc.; 1977; pp. 495-525.

English equivalent abstracts for Japanese Patent Publications 50-42190, 50-157496, and 55-142773; received 12-7-89.

*Primary Examiner*—Shrive Beck

*Assistant Examiner*—Alain Bashore

*Attorney, Agent, or Firm*—Heller, Ehrman, White & McAuliffe

[57] ABSTRACT

A hot-melt sizing agent with melting point 50°-100° C. is attached to warps inside a heated chamber at a temperature of 150° or below and at viscosity of 100 centipoise or below and the warps are thereafter bent inside the chamber by means of three or more free rollers. The hot-melt sizing agent contains 70 wt % or more of ester wax of one or more specified kinds and 30 wt % or less of hydrocarbon wax.

24 Claims, 1 Drawing Sheet

METHOD OF HOT-MELT SIZING OF WARPS FOR WEAVING

This is a continuation of application Ser. No. 257,408 filed Oct. 13, 1988 now abandoned.

BACKGROUND OF THE INVENTION

This invention relates to a method of hot-melt sizing of warps for weaving.

Sizing is important as a preparatory process for weaving in order to obtain good weaving performance from yarns by providing them tenacity and cohesiveness. There are many sizing methods including use of conventional sizing agents, oiling agents and hot-melt sizing agents. The present invention relates in particular to methods which use a hot-melt sizing agent.

According to conventional "sizing" methods, warps are dipped in an aqueous solution or water dispersant of a sizing agent, squeezed by press rollers and dried. Methods of this conventional type are disadvantageous, however, because much energy, time and space are required for the drying process. In some areas of fabric industries, there have been sizing methods without using any sizing agent or by using an oiling agent instead of a sizing agent. These methods, however, are usable only in very limited areas and not as universally applicable as methods with conventional sizing agents.

In view of the above, a method of using a hot-melt sizing agent has been considered as a new method of sizing (U.S. Pat. No. 3,466,717). According to this method, a molten sizing agent (a hot-melt sizing agent) is applied to warps by a roller touch method and is thereafter solidified Although many hot-melt sizing agents have been proposed (U.S. Pat. Nos. 4,136,069, 4,253,840 and 4,401,782 and Japanese Patent Publications Tokkai 50-42190, 50-157496 and 55-142773), melt Viscosity of these sizing agents is too high. These sizing agents, therefore, cannot be uniformly attached to warps or penetrate sufficiently into the interior of warps if they are merely melted by heating and applied to warps. As a result, neither yarn tenacity nor cohesiveness can be attained as expected and the yarns themselves tend to become damaged by tackiness of the applied sizing agent. Although it has been considered in view of the above to reduce the melt viscosity of hot-melt sizing agent (U.S. Pat. No. 4,459,129 and Japanese Patent Publication Tokko 48-23996), this makes it difficult for the sizing agent to solidify and a special forced cooler becomes necessary if it is desired to speed up the sizing process. Even with such a forced cooler, yarns tend to become fixed among themselves (or the so-called "blocking") because the sizing agent does not solidify completely.

SUMMARY OF THE INVENTION

It is therefore an object of the present invention to provide an improved method of hot-melt sizing with which the problems associate with prior art hot-melt sizing methods described above can be eliminated.

The present invention has been completed as a result of diligent studies by the present inventors in view of the above and other objects and is based on their discovery that desired results are obtained if a hot-melt sizing agent of a particular kind is applied to warps under specified conditions within a heated chamber and the warps are subsequently bent by means of free rollers with even surfaces inside this chamber.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
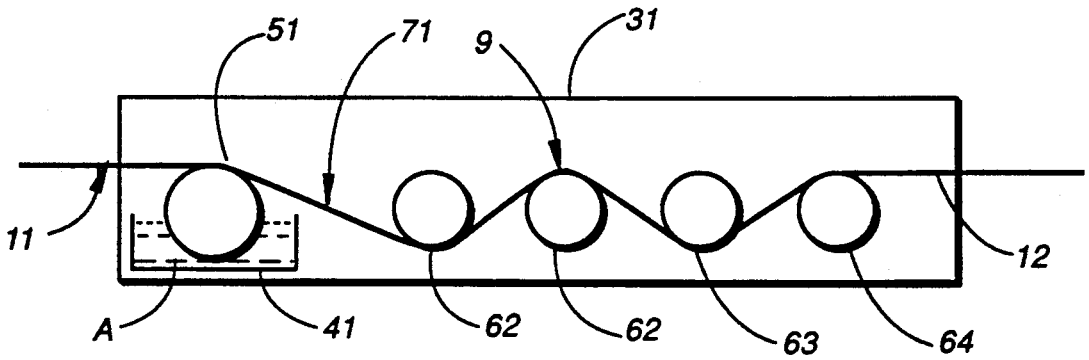
FIG. 1 is a schematic front sectional view of a sizing apparatus usable for the present invention.

Methods of hot-melt sizing according to the present invention are characterized by the steps of attaching a hot-melt sizing agent with melting point of 50°-100° C. to warps at a temperature of 150° C. or below and melt viscosity of 100 centipoise or below inside a heated chamber and of subsequently bending said warps inside this chamber by means of a plurality of free rollers having even surfaces.

The hot-melt sizing agent to be used according to the present invention is one having a melting point in the range of 50°-100° C. The rate of solidification is slow with those with a melting point below 50° C. while scourability becomes significantly poor with those with a melting point in excess of 100° C. Use should preferably be made of a hot-melt sizing agent with a melting point in the range of 60°-90° C. Examples of hot-melt sizing agent with melting point between 50°-100° C. include many kinds of wax. Preferable among them are those containing 50% or more by weight, and more preferably 70% or more by weight, of one or more kinds of ester wax selected from esters of aliphatic acid with 18-30 carbon atoms and aliphatic alcohol with 18-30 carbon atoms, completely or partially esterified polyhydric alcohol with aliphatic acid having 18-30 carbon atoms completely or partially esterified polybasic acid with aliphatic alcohol having 18-30 carbon atoms, and their oxidized derivatives. This ester wax may be natural, artificial or a mixture of both kinds. Examples of natural ester wax include carnauba wax, rice bran wax, montan wax, candelilla wax, and bees wax. Examples of artificial ester wax include both those obtained from natural wax by modification such as oxidation, saponification and hydrogenation and those obtained purely by artificial syntheses. Examples of purely synthetic ester wax include ester of behenic acid and stearyl alcohol or behenyl alcohol, diester of behenic acid and ethylene glycol, partially or completely esterified glycerine with behenic acid, mono-, di- or tri-ester of behenic acid with sorbitol or pentaerythritol, ester of behenyl alcohol and stearic acid or behenic acid, and mono- or di-ester of behenyl alcohol and adipic acid, azelaic acid or sebacic acid.

These kinds of ester wax have good affinity with a wide range of fibers from hydrophilic ones such as cotton to hydrophobic ones such as polyesters. Moreover, they have favorable sized yarn characteristics such as low melt viscosity, a sharply defined melting point, fast rate of solidification, no tackiness after solidifying and scourability. As a result, high-speed sizing can be effected without any special forced cooler and sized yarns of extremely superior physical properties such as tenacity and cohesiveness can be obtained. In summary, the present invention makes high-quality woven products obtainable.

In order to further improve lubricity of sized yarns, hot-melt sizing agents according to the present invention should preferably contain less than 30% by weight of hydrocarbon wax in addition to ester wax of the aforementioned type from the points of view of scourability, tenacity and cohesiveness. Examples of such hydrocarbon wax include paraffin wax, microcrystalline wax and polyethylene wax but sizing agents containing 5-20 wt % of paraffin wax or microcrystalline wax with melting point 60°-90° C. are particularly preferable.

The present invention further teaches that a hot-melt sizing agent of the kind described above be applied to warps at a temperature of 150° C. or below inside a heated chamber and at viscosity of 100 centipoise or below, and more preferably at a temperature of 120° C. or below and at viscosity of 100 centipoise or below. It is not preferable to raise the temperature in excess of 150° C. because it is simply a waste of energy and the physical properties of yarns become adversely affected. If viscosity exceeds 100 centipoise, penetration into the interior of yarns becomes slow and uniformity in attachment becomes insufficient. The interior of the chamber may be heated by hot air, steam, heat radiation or a hot roller. Heating may be effected without providing a chamber but the waste of energy is increased. If a hot-melt sizing agent according to the present invention is applied to warps at a temperature of 150° C. or below inside a heated chamber at viscosity of 100 centipoise or below and if rollers are used for bending as will be explained more fully below, the sizing agent can be uniformly attached to the warps by penetrating into their interior to thereby fully serve its intended purposes.

The present invention further teaches that the warps to which a hot-melt sizing agent has thus been attached be subsequently bent within the heated chamber by means of free rollers having even surfaces. By "even surfaces" are meant in the present invention surfaces having no groove. By "bending" is not meant in connection with the present invention contacting the warps to the free rollers at a point and causing them to pass tangentially with respect to these rollers but contacting the warps to the free rollers circumferentially and causing the rollers to change the directions of passage of the warps. Although roller touch methods are commonly used for applying a hot-melt sizing agent to warps and there are roller touch methods of many kinds, a hot-melt sizing agent cannot be uniformly attached to warps by a roller touch method alone. In order to apply a hot-melt sizing agent to warps uniformly and to cause it to sufficiently penetrate their interior, it is essential not only to apply the agent to warps but also to subsequently bend the warps inside a heated chamber by means of free rollers having even surfaces.

Rollers to be used according to the present invention for bending are free rollers having even surfaces become damaged if use is made of rollers with uneven surfaces If driving rollers are used, on the other hand, frictional resistance becomes large because a difference occurs inevitably as a practical matter between the circumferential speed of the rollers and the speed of the warps and this also has the effect of damaging the warps. In order to attach a hot-melt sizing agent uniformly to warps and to cause it to sufficiently penetrate their interior, it is preferable to bend the warps after sizing by means of three or more of such free rollers although this also depends on the diameter of the rollers, speed of the warps and the extent of bending. From the point of view of the structure of production line, it is preferable to dispose these free rollers vertically as a whole.

With reference to FIG. 1, schematically showing a sizing apparatus which can be used for the method of the present invention, a chamber 31 for heating by hot air provided with an inlet 11 and an outlet 12 contains therein a hot-melt sizing agent A in a molten state inside a sizing box 41 with a heater, a sizing roller 51 which contains a heater, is disposed above the sizing box 41 and operates while a part thereof is dipped in the aforementioned hot-melt sizing agent A and a total of four free rollers 61-64 having even surfaces and disposed horizontally one next to another between the sizing roller 51 and the outlet 12. After the hot-melt sizing agent A is attached to warps 71 by the sizing roller 51, the warps 71 are bent in alternate directions by the free rollers 61-64 and then taken up outside the chamber 31.

Figure 2:
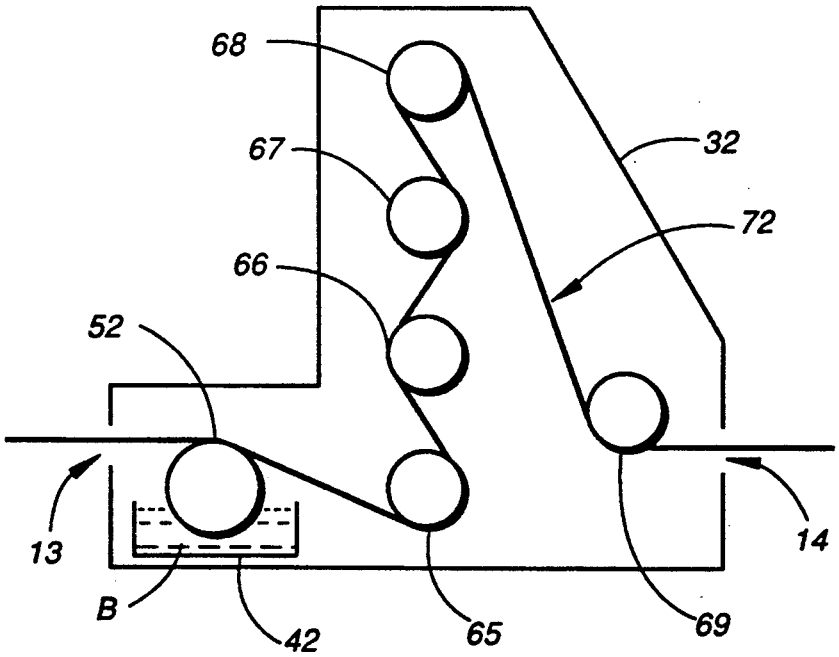
FIG. 2 is a schematic front sectional view of another sizing apparatus which may be used for the present invention.

Another sizing apparatus which can be used for the method of the present invention is shown in FIG. 2. A chamber 32 heated by a far-infrared heater has an inlet 13 and an outlet 14 and contains a hot-melt sizing agent B in a molten state in a sizing box 42 with a heater, a sizing roller 52 which contains a heater, is disposed above the sizing box 42 and operates while a part thereof is dipped in the aforementioned hot-melt sizing agent B and a total of four free rollers 65-68 having even surfaces and disposed vertically one above another between the sizing roller 52 and the outlet 14. After the hot-melt sizing agent B is attached to warps 72 by the sizing roller 52, the warps 72 are bent in alternate directions by the free rollers 65-68 and then taken up outside the chamber 32.

A hot-melt sizing agent according to the present invention may additionally contain, if necessary, appropriate polymeric modifiers, surfactants, antistatic agents and antioxidants. The rate at which the sizing agent should be attached to warps is generally 1-20 wt %, or more preferably 3-15 wt %, in the case of spun yarns, and is generally 1-15 wt %, or more preferably 3-10 wt %, in the case of multifilament yarns.

The present invention is applicable to beam warper, warp beamer, sectional warper and any other processes but it is particularly preferable to apply it in the beam warper process. Yarns to which the present invention is applicable include both spun and filament yarns. Examples of spun yarns include single yarns and two-folded yarns of cotton, polyester, rayon, polyester/cotton and polyester/rayon. Examples of multifilament yarns include non-twist yarns, twist yarns, false twist yarns and intermingled yarns of polyester, nylon, acetate and rayon.

In what follows, experiments and their results are shown to better explain the present invention but the scope of the present invention is not intended to be limited by these test examples.

In a first series of tests, sizing agents as shown in Table 1 were prepared and after the sizing apparatus shown in FIG. 1 was used (except for Comparison Examples 1-3) for sizing sixty pieces of 40/1, 100% cotton yarn (Comparison Example 1 is non-sized yarn), their physical properties were evaluated. Table 1 also shows the results of evaluation. Sizing was carried out as follows: Setting=20 ends/inch; Speed of Yarns=200 m/min.; Temperature Inside the Chamber 31=120° C.;

Temperature of the Sizing Box 41 and the Sizing Roller 51=100° C.; Contact Angle ($\theta$ in FIG. 1) Between Yarn and Free Rollers 61, 62 and 63=about 70°; Contact Angle Between Yarn and Free Roller 64=about 40°; and Distance Between the Outlet 12 and the Take-Up Beam (not shown)=5 m (no forced cooling).

For the TM-type abrasion test (F/M in Table 1), use was made of a yarn cohesion tester model TM (produced by Daiei Kagaku Seiki Mfg. Co. Ltd.) to abrade each yarn with a metal comb under the following conditions and the cycle number of abrasion until the yarn was broken (average of 10 measurements) was measured: Contact Angle=125°, Tension=50 g, and Number of Yarns=1.

For the rubbing test (F/F in Table 1), use was made of a yarn friction and rubbing tester (produced by Toyo Seiki Seisakusho Ltd.) to rub the yarns among themselves under the following conditions and the cycle number of abrasion until they broke (average of 10 measurements) was measured: Twist=360°×1 turn, Angle of Intersection=35°, Tension=100 g, and Number of Yarns=1.

In addition, sized yarns of Test Example 3 of Table 1 were actually used for weaving by means of an air jet loom. Weaving performance was extremely good.

In a second series of tests, sizing agents as shown in Table 2 were prepared and after the sizing apparatus shown in FIG. 2 was used (except for Comparison Examples 6–8) for sizing sixty pieces of polyester yarn 50 denier/36 filament (trigonal cross-section, bright yarn with 300 twist/m) (except Comparison Example 6 was non-sized yarn), their physical properties were evaluated. The results of evaluation are also shown in Table 2. Sizing was carried out as follows: Setting=20 ends/inch; Speed of Yarns=200 m/min.; Temperature Inside the Chamber 32=120° C.; Temperature of the Sizing Box 42 and the Sizing Roller 52=100° C.; Contact Angle Between the Fiber and Free Roller 65=about 150°; Contact Angle Between Fiber and Free Rollers 66, 67 and 69=about 80°; Contact Angle Between Fiber and Free Roller 68=about 210°; and Distance Between the Outlet 14 and the Take-Up Beam (not shown)=5 m (no forced cooling). On both TM-type abrasion tests (F/M in Table 2) and rubbing tests (F/F in Table 2) were carried out as explained above except tension was 150 g for both tests and testing was conducted with a spray of water. Cohesiveness was tested by cutting at once with a pair of scissors while a tensile force of 150 g was applied to each sized yarn and by measuring the length of its opening. The smaller this length, the better.

In addition, sized yarns of Test Example 5 were actually used for weaving by means of a water jet loom. Its weaving performance was very good.

The test results shown in Tables 1 and 2 clearly indicate that the method according to the present invention is advantageous from the points of view of universal applicability, energy saving, process saving, space saving and high productivity and that high-quality sized yarns and woven products can be obtained thereby.

TABLE 1

| | TEST | | | | | COMPARISON | | | | |
|---|---|---|---|---|---|---|---|---|---|---|
| | 1 | 2 | 3 | 4 | 5 | 1 | 2 | 3 | 4 | 5 |
| Rollers | *1 | *1 | *1 | *1 | *1 | | | *2 | *1 | *1 |
| Composition of sizing agent | | | | | | *4 | *5 | | | *6 |
| A-1 | 60 | 60 | 50 | | | | | 60 | | |
| A-2 | | 20 | | 20 | | | | | | |
| A-3 | 40 | | | 10 | | | 40 | | | |
| A-4 | | 20 | 30 | | 10 | | | | | |
| A-5 | | | | 50 | 40 | | | | | |
| A-6 | | | | | 30 | | | | | |
| B-1 | | | 20 | 20 | 20 | | | | | |
| B-2 | | | | | | | | | 100 | |
| S-1 (°C.) | 80 | 80 | 80 | 80 | 75 | | | 80 | 40 | 40 |
| S-2 (cp) | 15 | 20 | 20 | 15 | 15 | | | 15 | 10 | 50 |
| S-3 (%) | 10.8 | 10.6 | 10.7 | 10.9 | 10.8 | | 14.0 | 10.5 | 10.6 | 10.7 |
| Yarn Tenacity (g) | 241 | 240 | 238 | 237 | 235 | 162 | 245 | 180 | 169 | 189 |
| F/M (cycle) | 770 | 810 | 1180 | 1230 | 1450 | 180 | 440 | 520 | 490 | 410 |
| F/F (cycle) | 1280 | 1310 | 1210 | 1260 | 1390 | 210 | 630 | 720 | 580 | 550 |
| Blocking *3 | No | No | No | No | No | No | No | No | Yes | Much |

(Notes)
*1: With free rollers (apparatus of FIG. 1)
*2: No free rollers (only roller touch with sizing roller)
*3: Blocking on take-up beam
*4: Non-sized yarn
*5: Processed by conventional aqueous sizing agent (comprising polyvinyl alcohol/cornstarch/acrylic size/lubricant = 55/40/2/3) at 80 m/min.
*6: Obtained by melting 273 g of paraffin wax (with melting point of 120° F.) and 40 g of stearic acid by heating to 140° C., dropping thereinto a mixture of 72 g of methyl acrylate, 12 g of styrene, 68 g of stearyl methacrylate, 17 g of methacrylic acid, 7 g of acrylic acid and 3 g of AIBN over a period of 1.5 hours, completing the reaction after 1 hour, cooling it to 80° C. and then adding 50% potassium hydroxide to neutralize.
A-1: Carnauba wax
A-2: Glycerol monobehenate
A-3: Oxidized derivatives of Montan wax (Hoechst wax S produced by Hoechst Aktiengesellschaft)
A-4: Monobehenyl sebacate
A-5: Rice bran wax
A-6: Stearyl stearate
B-1: Microcrystalline wax (melting point = 75° C.)
B-2: Paraffin wax (melting point = 40° C.)
S-1: Melting point of sizing agent (about)
S-2: Melt viscosity of sizing agent at 100° C. (cp)
S-3: Amount of sizing agent attached (wt %)

TABLE 2

| | TEST | | | | COMPARISON | | | | |
|---|---|---|---|---|---|---|---|---|---|
| | 6 | 7 | 8 | 9 | 6 | 7 | 8 | 9 | 10 |
| Rollers | *7 | *7 | *7 | *7 | | | *8 | *7 | *7 |
| Composition of sizing agent | | | | | *9 | *10 | | | *11 |
| A-1 | 30 | | 40 | 20 | | | 30 | | |
| A-7 | | 30 | | 20 | | | | | |
| A-3 | 70 | 60 | 40 | 40 | | | 70 | | |
| A-8 | | 10 | 10 | 10 | | | | | |
| B-3 | | | 10 | 10 | | | | | |
| C-1 | | | | | | | | 100 | |
| S-1 (°C.) | 80 | 80 | 80 | 80 | | | 80 | 40 | 100 |
| S-2 (cp) | 15 | 15 | 15 | 15 | | | 15 | 10 | *13 |
| S-3 (%) | 4.2 | 4.3 | 4.5 | 4.2 | | 8.1 | 4.3 | 4.4 | |
| F/M (cycle) | *12 | *12 | *12 | *12 | 440 | 850 | 570 | 510 | |
| F/F (cycle) | *12 | *12 | *12 | *12 | 10 | *12 | 620 | 320 | *14 |
| Cohesiveness (mm) | 9 | 10 | 9 | 10 | 22 | 8 | 15 | 19 | |
| Blocking *3 | No | No | No | No | No | No | No | Yes | |

(Notes)
*7: With free rollers (apparatus shown in FIG. 2)
*8. No free rollers (only roller touch with sizing roller)
*9: Non-sized yarn
*10: Processed with ordinary aqueous sizing agent (Plassize J-95/Sytex K-330 = 95/5 produced by Goo Chemical Ind. Co. Ltd.) at 100 m/min.
*11: Partially saponified polyvinyl acetate
*12: Greater than 1500
*13: 3000 cp at 150° C.
*14: Non-sizable
A-7: Dibehenyl adipate
A-8: Monobehenyl dihydrogen citrate
B-3: Paraffin wax (melting point = 70° C.)
C-1: Lauryl palmitate

What is claimed is:

1. A method of hot-melt sizing of warps for weaving, said method comprising the steps of attaching a hot-melt sizing agent with melting point 50°-100° C. to warp inside a heated chamber at a temperature of 150° C. or below and at viscosity of 100 centipoise or below, said hot-melt sizing agent containing 70 wt % or more of one or more kinds of ester wax, and thereafter bending said warps inside said chamber by means of a plurality of free rollers with even surfaces, wherein the yarn tenacity of said warps is significantly improved.

2. The method of claim 1 wherein said one or more kinds of ester wax are selected from the group consisting of esters of aliphatic acid having 18-30 carbon atoms and aliphatic alcohol having 18-30 carbon atoms, completely or partially esterified polyhydric alcohol with aliphatic acid having 18-30 carbon atoms, completely or partially esterified polybasic acid with aliphatic alcohol having 18-30 carbon atoms, and oxidized derivatives thereof.

3. The method of claim 2 wherein said hot-melt sizing agent includes 30 wt % or less of hydrocarbon wax.

4. The method of claim 1 wherein said warps are bent by means of three or more free rollers.

5. The method of claim 2 wherein said warps are bent by means of three or more free rollers.

6. The method of claim 3 wherein said warps are bent by means of three or more free rollers.

7. The method of claim 4 wherein said free rollers are vertically mounted.

8. The method of claim 5 wherein said free rollers are vertically mounted.

9. The method of claim 6 wherein said free rollers are vertically mounted.

10. The method of claim 1 wherein said free rollers are arranged so as to move said warps in a zigzag path.

11. The method of claim 2 wherein said free rollers are arranged so as to move said warps in a zigzag path.

12. The method of claim 3 wherein said free rollers are arranged so as to move said warps in a zigzag path.

13. The method of claim 1 wherein said hot-melt sizing agent is a wax.

14. The method of claim 13 wherein said one or more kinds of ester wax are selected from the group consisting of esters of aliphatic acid having 18-30 carbon atoms and aliphatic alcohol having 18-30 carbon atoms, completely or partially esterified polyhydric alcohol with aliphatic acid having 18-30 carbon atoms, completely or partially esterified polybasic acid with aliphatic alcohol having 18-30 carbon atoms, and oxidized derivatives thereof.

15. The method of claim 14 wherein said hot-melt sizing agent includes 30 wt % or less of hydrocarbon wax.

16. The method of claim 13 wherein said warps are bent by means of three or more free rollers.

17. The method of claim 14 wherein said warps are bent by means of three or more free rollers.

18. The method of claim 15 wherein said warps are bent by means of three or more free rollers.

19. The method of claim 16 wherein said free rollers are vertically mounted.

20. The method of claim 17 wherein said free rollers are vertically mounted.

21. The method of claim 18 wherein said free rollers are vertically mounted.

22. The method of claim 13 wherein said free rollers are arranged so as to move said warps in a zigzag path.

23. The method of claim 14 wherein said free rollers are arranged so as to move said warps in a zigzag path.

24. The method of claim 15 wherein said free rollers are arranged so as to move said warps in a zigzag path.

* * * * *